US012416225B2

(12) United States Patent
Duan et al.

(10) Patent No.: US 12,416,225 B2
(45) Date of Patent: Sep. 16, 2025

(54) DENSITY-BASED FLOW CONTROL CONFIGURATION, METHOD, AND SYSTEM

(71) Applicant: Baker Hughes Oilfield Operations LLC, Houston, TX (US)

(72) Inventors: Ping Duan, Cypress, TX (US); Guijun Deng, The Woodlands, TX (US); Zhihui Zhang, Katy, TX (US); John Wakefield, Cypress, TX (US); Daniel Ewing, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/366,281

(22) Filed: Aug. 7, 2023

(65) Prior Publication Data

US 2025/0052136 A1 Feb. 13, 2025

(51) Int. Cl.

| | |
|---|---|
| ***E21B 43/12*** | (2006.01) |
| ***E21B 34/08*** | (2006.01) |
| ***E21B 43/38*** | (2006.01) |

(52) U.S. Cl.

CPC ..... *E21B 43/12* (2013.01); *E21B 34/08* (2013.01); *E21B 43/385* (2013.01); *E21B 2200/02* (2020.05)

(58) Field of Classification Search

CPC ..... E21B 43/12; E21B 34/08; E21B 2200/02

See application file for complete search history.

(56) References Cited

U.S. PATENT DOCUMENTS

2013/0092382 A1 4/2013 Dykstra et al.
2015/0000751 A1 1/2015 Nicholson
2022/0195837 A1 6/2022 McChesney et al.
2022/0381112 A1 12/2022 Aladawy et al.
2024/0271509 A1* 8/2024 Rudic ..... E21B 34/08

FOREIGN PATENT DOCUMENTS

WO 2022240589 A1 11/2022

OTHER PUBLICATIONS

Notification of Transmittal of the International Search Report and the Written Opinion of the International Searching Authority, or the Declaration; PCT/US2024/041230; Mail Date: Nov. 18, 2024; 10 pages.

* cited by examiner

*Primary Examiner* — Kristyn A Hall

(74) *Attorney, Agent, or Firm* — Baker Hughes Patent Organization

(57) ABSTRACT

A density-based flow control configuration includes a housing and a first baffle having a first flow opening, a second baffle having a second flow opening adjacent the first baffle, one of the baffles being rotationally movable relative to the housing and to the other of the baffles, a first density float associated with the movable baffle, to impart torque to the associated baffle, the torque causing alignment or misalignment of the first and second openings. A method for allowing flow of a target fluid and choking flow of a nontarget fluid, including exposing a density-based flow control configuration to a fluid, imparting torque to a first baffle, and aligning or misaligning an opening in the first baffle with another opening to allow or choke flow of the fluid. A wellbore system, including a density-based flow control configuration.

23 Claims, 5 Drawing Sheets

DENSITY-BASED FLOW CONTROL CONFIGURATION, METHOD, AND SYSTEM

BACKGROUND

In the resource recovery and fluid sequestration industries fluid flows often include undesirable fluids mixed in with desirable fluids. Undesirable fluids, whether to be produced or to be sequestered increases cost, time, and tool life for no gain. This is to be avoided and the art is always receptive to new technologies that assist in this regard.

SUMMARY

An embodiment of a density-based flow control configuration, including a housing, a first baffle mounted in the housing and having a first flow opening, a second baffle having a second flow opening adjacent the first baffle, at least a first one of the first baffle and the second baffle being rotationally movable relative to the housing and to the other of the first baffle and the second baffle, a first selected density float associated with the rotationally movable one of the first or second baffles, the first float imparting torque to the associated baffle dependent upon a density of a fluid to which the first float is exposed, during use, the torque causing alignment or misalignment of the first and second openings depending upon the density of the fluid to which the first float is exposed, during use.

An embodiment of a method for automatically allowing flow of a target fluid and choking flow of a nontarget fluid, including exposing a density-based flow control configuration to a fluid, automatically imparting torque in a first direction or a second direction to a first baffle depending upon a density of the fluid, and aligning or misaligning an opening in the first baffle with another opening to allow or choke, respectively, flow of the fluid.

An embodiment of a wellbore system, including a borehole in a subsurface formation, a string in the borehole, and a density-based flow control configuration, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
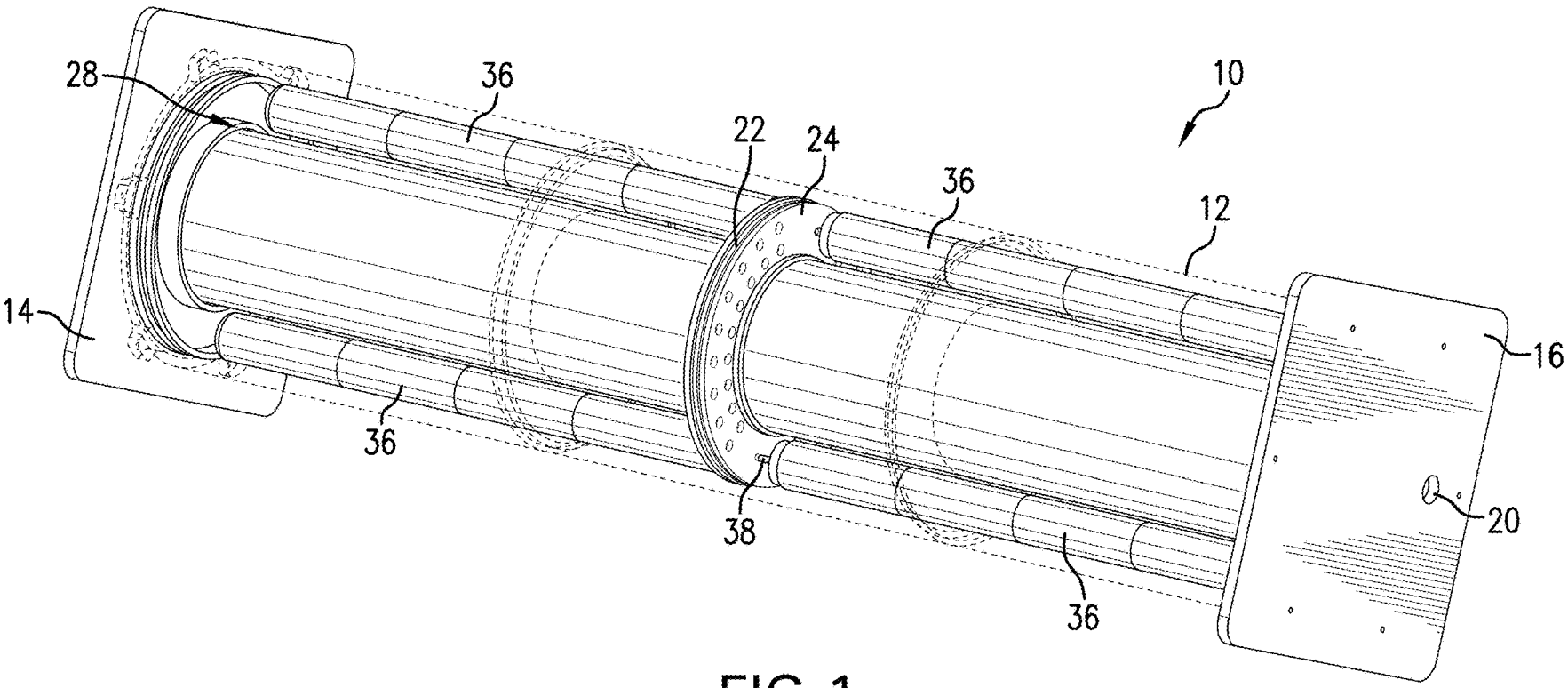
FIG. 1 is a perspective semi transparent view of the density-based flow control configuration disclosed herein.

Referring to FIG. 1, a density-based flow control configuration 10 is illustrated with an outer housing 12 shown in phantom to allow perception of components therewithin. Configuration 10 includes end plates 14 and 16 each of which include an opening 20 to allow fluid passage through the end plates 14 and 16. Within the outer housing 12, and but for the additional components to be introduce immediately hereafter, a fluid flowing through one of the end plates 16 would flow through the housing 12 and out the other end plate 14 or vice versa (assuming a pressure differential across the configuration 10 existed to support flow). To provide control of such flow, a plurality of baffles 22 and 24 are disposed within the housing 12, each baffle having a number of openings 26 therethrough. Two baffles are illustrated but more could be used or a single baffle interactive with a structure of the housing that includes an opening with which the baffle could be aligned or misaligned is also contemplated. The baffles 22 and 24 occupy an annular space 28, as illustrated. The annular space 28 is bounded radially outwardly by the outer housing 12 and inwardly by a cylindrical surface 30 that may be another tube or could be solid. The dimensions need not be as illustrated. More specifically, the radial dimension between the outer housing 12 and the surface 30 as illustrated could be larger or smaller by adjusting the diameter of the surface 30 or the diameter of the outer housing 12 with similar effect overall. The baffles 22 and 24 will always extend radially into proximity with the surface 30 and the outer housing 12 so that at least one of the baffles may be substantially sealed to these structures by seals 32 and 34. In another embodiment, Seals may be unnecessary. If the baffles 22 and 24 are arranged with a small enough gap, then leakage will be minimal. Baffles 22 and 24 may both be rotationally mobile or only one could be rotationally mobile. However, it is to be understood that if only one of the baffles is mobile, then orientation of the configuration 10 is important in order to ensure proper operation. The degree of mobility needs merely be enough to align or misalign respective openings 26 of each baffle 22 and 24 to either allow flow through the baffles (fully aligned openings 26) inhibit flow through the baffles (fully misaligned openings 26) or choke the flow (partially align openings 26). To render the adjustment of flow automatic, one or more floats 36 are employed (a plurality are illustrated). Each float 36 is constructed of a material that either has, or can be manipulated to have, a density that is selected to respond in a particular way to changes in the density of a fluid flowing through the configuration 10. Floats therefore may be a solid having a density that works for the purpose, could be a foam, could be an inflatable, a cavity filled with a low density oil ("low density" meaning the oil has a lower density than water), etc. The selected density, in one embodiment, is one that will sink in a desirable fluid such as oil and float in a desirable fluid such as water. This means that the float will move upwardly relative to gravity if there is more water is in the flow and downwardly relative to gravity if the flow has more oil. The baffles 22 and 24 are arranged to move relative to one another based upon the input from the float 36 such that the more water is in the flow, the less the overlap of the openings 26. The statement above about orientation being important will be clearer in view of the foregoing paragraph. Where only one baffle is mobile, the orientation of configuration 10 is needed to ensure the float will move relative to gravity and density in a way that operates the openings 26. It is also to be understood that the concepts discussed herein can be reversed such that the denser fluid is the desirable one and the less dense fluid is the undesirable one. This can be achieved by changing the float density.

To create this movement, the at least one float 36 needs to be torque transmittingly attached to one of the baffles. When that float 36 moves up or down relative to gravity, the associated baffle 22 or 24 will move rotationally. This movement will align or misalign openings 26. For water and oil embodiments, if there is more water in the flow, the float 36 will float and cause a misalignment of the openings 26. If more oil is in the flow, the float 36 will sink and thereby increase the alignment of the openings 26, which lets more flow through because oil is the desired target fluid.

Figure 2:
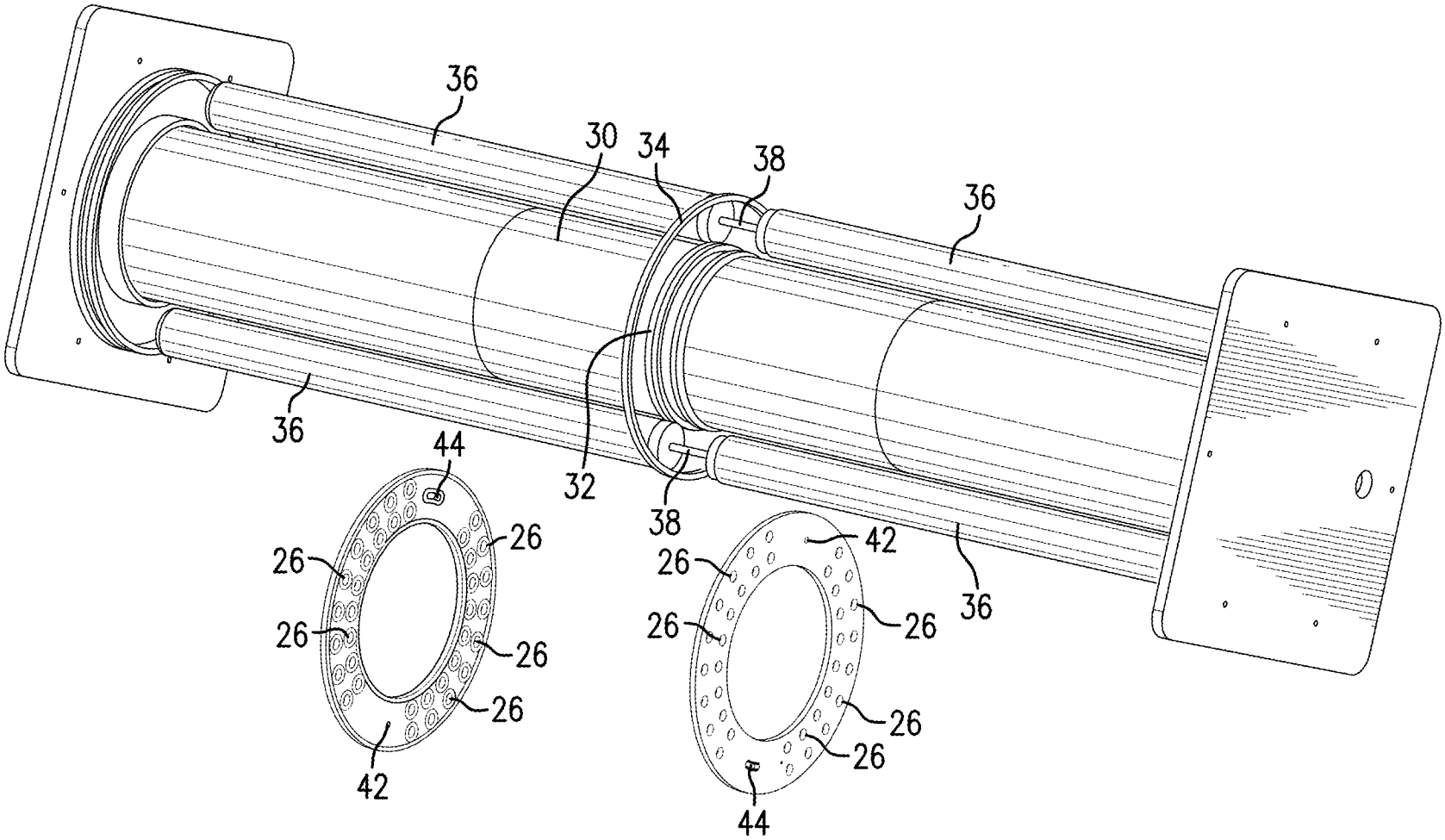
FIG. 2 is the configuration of FIG. 1 with the outer housing removed and two baffles pulled out of position.
Figure 3:
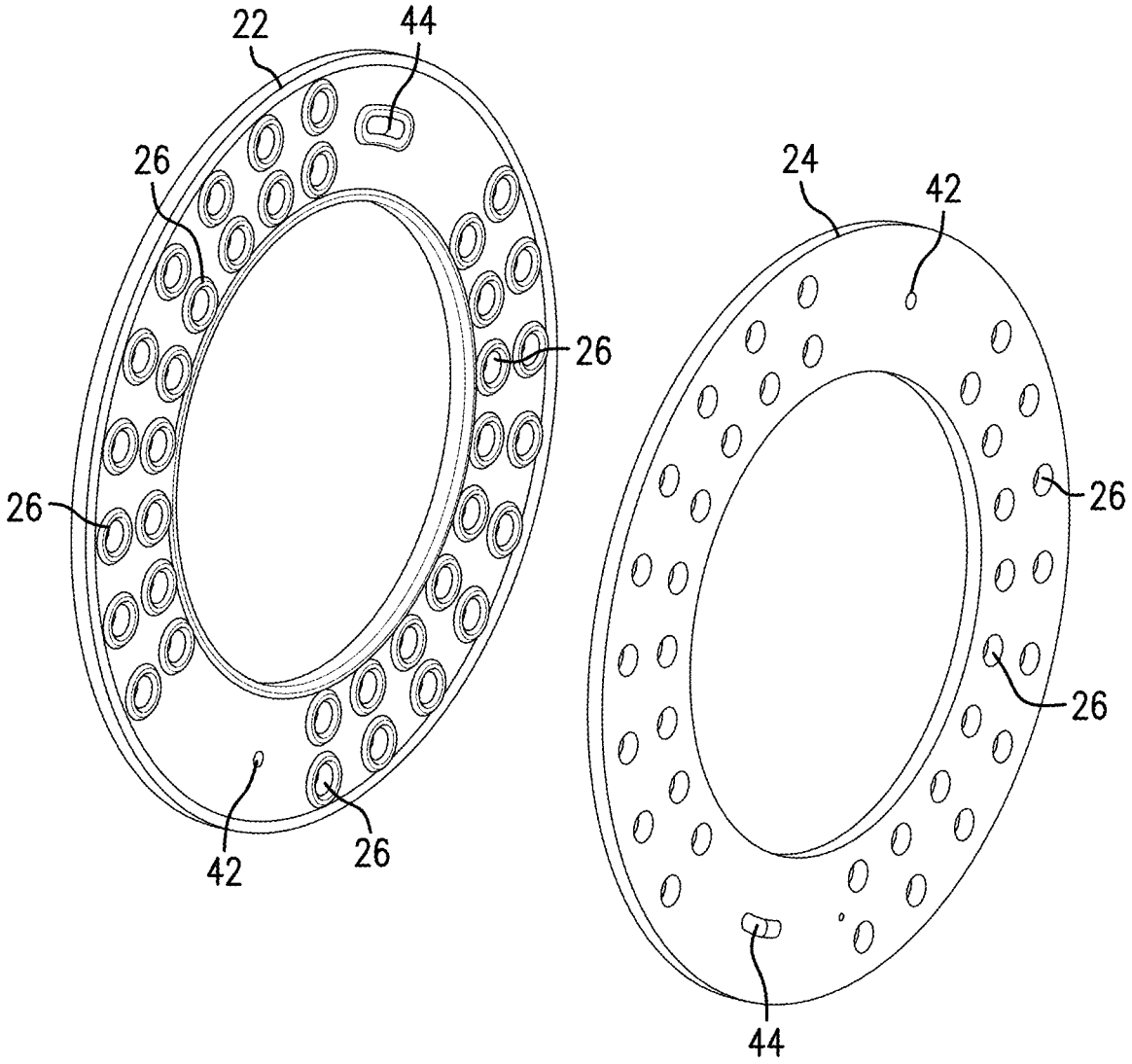
FIG. 3 is an enlarged view of the baffles.

If more than one float is used on a baffle, it is desirable to place each float 36 on opposing sides of that baffle. This is illustrated in FIG. 1 (twice, since both baffles have more than one float 36). A shaft 38 connects two of the floats 36 and extends through the two baffles 22 and 24. Referring to FIGS. 2 and 3, the baffles 22 and 24 are pulled out of the configuration 10 so that there particular geometries may be more easily appreciated. The rotational orientation of the baffles 22 and 24 is retained relative to the rest of FIG. 2 although the baffles have been spaced from one another to enhance understanding. Hence, it should be understood that the shaft 38 will go through aperture 42 and will be in a position to impart torque to the associated baffle. The nonassociated baffle is provided a slot 44 through which the shaft 38 extends so that the shaft may move the associated baffle without imparting torque to the baffle with the slot 44 (the nonassociated baffle). Both of the illustrated baffles have these components on opposing sides as illustrated. Accordingly, if water is encountered, the floats 36 will float and baffle 22 will be rotated clockwise in FIG. 2 while baffle 24 will be rotated counterclockwise in FIG. 2. This will misalign the openings 26 and reduce flow through configuration 10. With oil in the flow, the opposite will occur. The floats 36 will drop and rotate baffle 22 counterclockwise and baffle 24 clockwise thereby aligning the openings 26.

Figure 4:
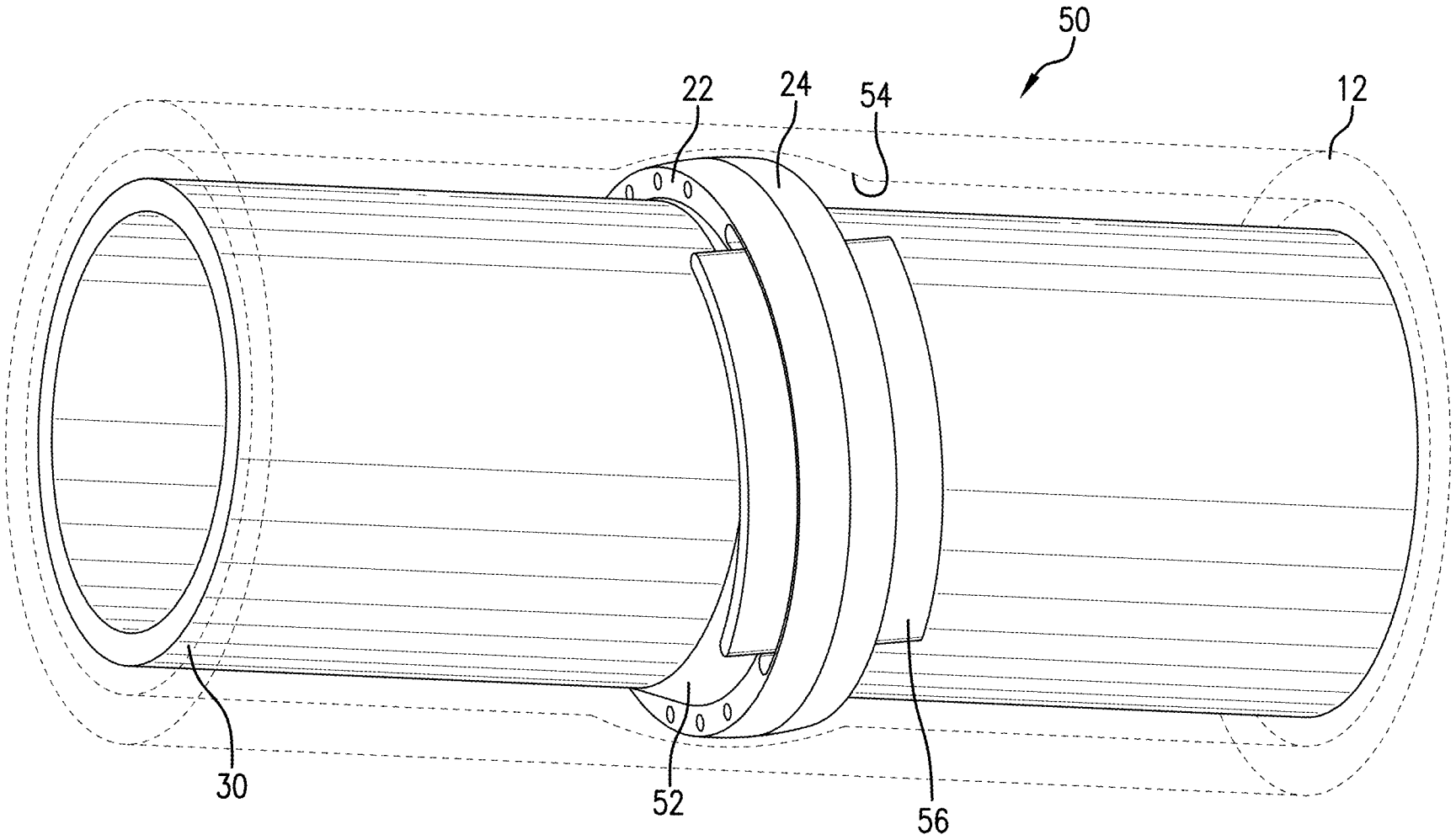
FIG. 4 is a perspective view of an alternate embodiment.

Referring to FIG. 4, an alternate configuration 50 is illustrated. The difference for this embodiment is that the operating components that have been described above are not fixed spatially relative to the housing like in the foregoing embodiment but rather can move spatially so that when the configuration 50 is not horizontally disposed, the baffle system can right itself to gravity. Performance may be enhanced in some cases by providing this degree of freedom. The function is enabled by mounting the baffles on a ball structure 52 and providing a ball cavity at the inside surface 54 of the housing 12. Further, it will be appreciated that the floats 36 and shafts 38 have been replaced with floats 56 that are disposed along the baffles 22 and 24 to provide greater angular mobility that the much longer floats 36 from the previously described embodiment would inhibit. The float 56 is attached to on baffle (in FIG. 4 it is attached to baffle 24) and is located in a slot 44 of baffle 22 and functions essentially in the same way. Out of sight in this Figure, is another float 56 that will be connected to baffle 22 and disposed in slot 44 of baffle 24 if indeed a second float 56 is to be employed.

Figure 5:
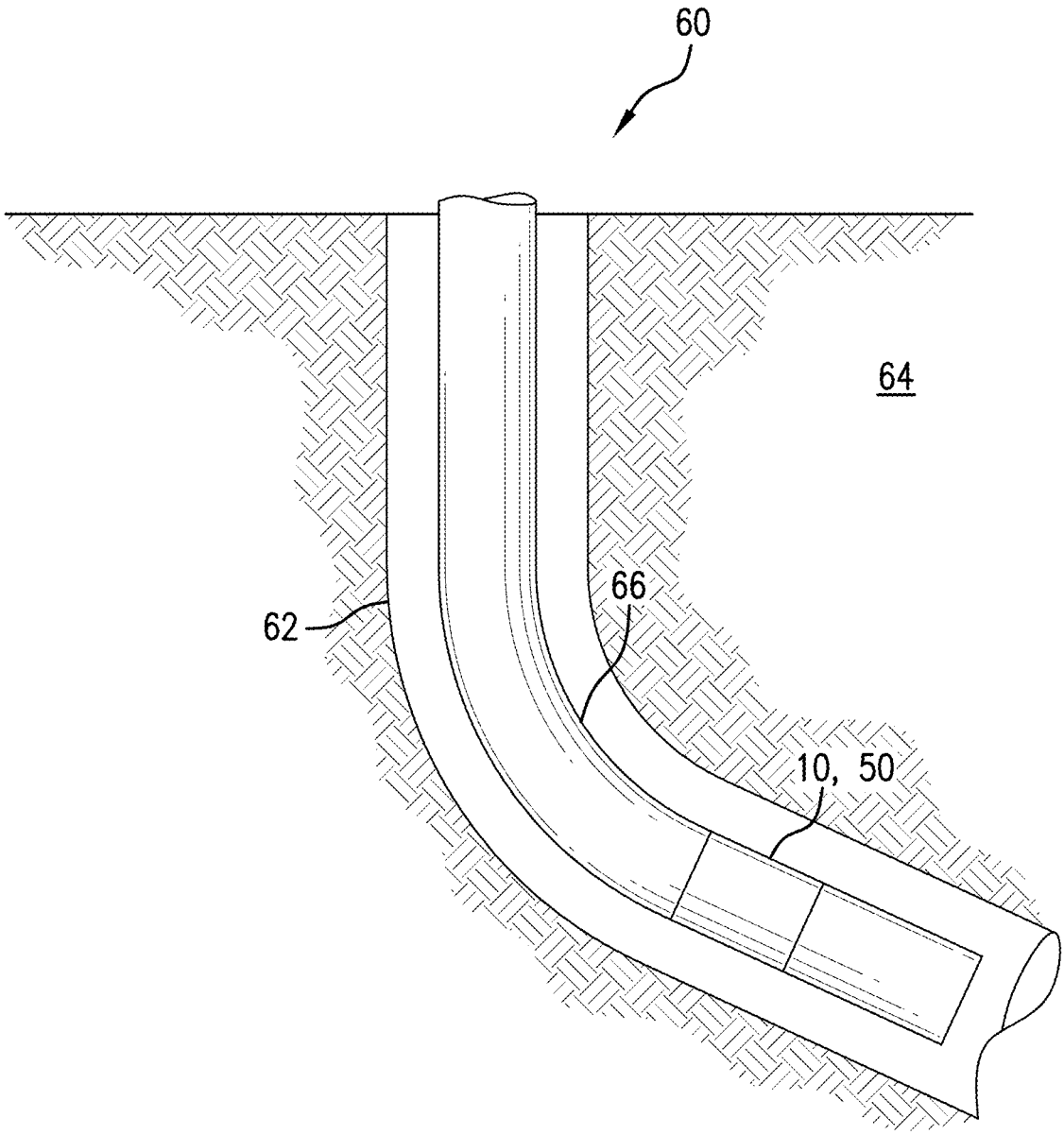
FIG. 5 is a view of a borehole system including the density-based flow control configuration as disclosed herein.

Referring to FIG. 5, a borehole system 60 is illustrated. The system 60 comprises a borehole 62 in a subsurface formation 64. A string 66 is disposed within the borehole 62. A density-based flow control configuration 10 or 50 as disclosed herein is disposed within or as a part of the string 66.

Set forth below are some embodiments of the foregoing disclosure:

Embodiment 1

A density-based flow control configuration, including a housing, a first baffle mounted in the housing and having a first flow opening, a second baffle having a second flow opening adjacent the first baffle, at least a first one of the first baffle and the second baffle being rotationally movable relative to the housing and to the other of the first baffle and the second baffle, a first selected density float associated with the rotationally movable one of the first or second baffles, the first float imparting torque to the associated baffle dependent upon a density of a fluid to which the first float is exposed, during use, the torque causing alignment or misalignment of the first and second openings depending upon the density of the fluid to which the first float is exposed, during use.

Embodiment 2

The configuration as in any prior embodiment, wherein the selected density floats in water and sinks in oil.

Embodiment 3

The configuration as in any prior embodiment, wherein the one of the first or second baffles not associated with the first float defines an arcuate opening to permit movement of the associated first float with the first or second baffle with which it is associated.

Embodiment 4

The configuration as in any prior embodiment, wherein the first float is movable relative to the associated first or second baffle in a radially directed slot defined by the associated first or second baffle.

Embodiment 5

The configuration as in any prior embodiment, wherein the first float includes a first plurality of bodies.

Embodiment 6

The configuration as in any prior embodiment, wherein a first at least two bodies of the first plurality of bodies are on opposed sides of the associated first or second baffles.

Embodiment 7

The configuration as in any prior embodiment, wherein the first at least two bodies of the first plurality of bodies are connected to each other by a shaft that also secures the at least two bodies to the associated first or second baffles.

Embodiment 8

The configuration as in any prior embodiment, where a second one of the first baffle and the second baffle is also rotationally movable relative to the housing and to the first one of the first baffle and the second baffle.

Embodiment 9

The configuration as in any prior embodiment, further comprising a second selected density float associated with the second one of the first or second baffle.

Embodiment 10

The configuration as in any prior embodiment, wherein the second float imparts torque to the associated baffle dependent upon a density of the fluid to which the first and second floats are exposed, during use, the torque causing alignment or misalignment of the first and second openings depending upon the density of the fluid to which the first and second floats are exposed, during use.

Embodiment 11

The configuration as in any prior embodiment, wherein the second float is movable relative to the associated first or second baffle in a radially directed slot defined by the associated first of second baffle.

Embodiment 12

The configuration as in any prior embodiment, wherein the first or second one of the first or second baffles not associated with the second float defines an arcuate opening to permit movement of the associated second float with the other of the first or second baffle with which it is associated.

Embodiment 13

The configuration as in any prior embodiment, wherein the second float includes a second plurality of bodies.

Embodiment 14

The configuration as in any prior embodiment, wherein a second at least two bodies of the second plurality of bodies are on opposed sides of the associated first or second baffle.

Embodiment 15

The configuration as in any prior embodiment, wherein the second at least two bodies are connected to each other by a shaft that also secures the second at least two bodies to the associated first or second baffle.

Embodiment 16

The configuration as in any prior embodiment, wherein the first baffle and second baffle are spatially free to rotate to find level when the configuration is disposed other than horizontally, when in use.

Embodiment 17

The configuration as in any prior embodiment, wherein the outer housing includes a ball cavity.

Embodiment 18

The configuration as in any prior embodiment, further including a ball structure radially inwardly disposed of the first baffle and the second baffle.

Embodiment 19

A method for automatically allowing flow of a target fluid and choking flow of a nontarget fluid, including exposing a density-based flow control configuration to a fluid, automatically imparting torque in a first direction or a second direction to a first baffle depending upon a density of the fluid, and aligning or misaligning an opening in the first baffle with another opening to allow or choke, respectively, flow of the fluid.

Embodiment 20

The method as in any prior embodiment, wherein the imparting torque is by floating or sinking a float, that is secured to the baffle, in the fluid.

Embodiment 21

The method as in any prior embodiment, further including automatically imparting torque in a first direction or a second direction to a second baffle adjacent the first baffle, depending upon a density of the fluid.

Embodiment 22

The method as in any prior embodiment, wherein the another opening is in a second baffle, the second baffle being positionable relative to the first baffle.

Embodiment 23

A wellbore system, including a borehole in a subsurface formation, a string in the borehole, and a density-based flow control configuration, as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A density-based flow control configuration, comprising:

a housing;

a first baffle mounted in the housing and having a first flow opening;

a second baffle having a second flow opening adjacent the first baffle, at least a first one of the first baffle and the second baffle being rotationally movable relative to the housing and to the other of the first baffle and the second baffle;

a first selected density float mechanically connected by a shaft with the rotationally movable one of the first or second baffles, the first float imparting torque to the associated baffle dependent upon a density of a fluid to which the first float is exposed, during use, the torque causing alignment or misalignment of the first and second openings depending upon the density of the fluid to which the first float is exposed, during use.

2. The configuration as claimed in claim 1, wherein the selected density floats in water and sinks in oil.

3. The configuration as claimed in claim 1, wherein the one of the first or second baffles not associated with the first float defines an arcuate opening to permit movement of the associated first float with the first or second baffle with which it is associated.

4. The configuration as claimed in claim 1, wherein the first float is movable relative to the associated first or second baffle in a radially directed slot defined by the associated first or second baffle.

5. The configuration as claimed in claim 1, wherein the first float includes a first plurality of bodies.

6. The configuration as claimed in claim 5, wherein a first at least two bodies of the first plurality of bodies are on opposed sides of the associated first or second baffles.

7. The configuration as claimed in claim 6, wherein the first at least two bodies of the first plurality of bodies are connected to each other by the shaft that also secures the at least two bodies to the associated first or second baffles.

8. The configuration as claimed in claim 1, where a second one of the first baffle and the second baffle is also rotationally movable relative to the housing and to the first one of the first baffle and the second baffle.

9. The configuration as claimed in claim 8, further comprising a second selected density float associated with the second one of the first or second baffle.

10. The configuration as claimed in claim 9, wherein the second float imparts torque to the associated baffle dependent upon a density of the fluid to which the first and second floats are exposed, during use, the torque causing alignment or misalignment of the first and second openings depending upon the density of the fluid to which the first and second floats are exposed, during use.

11. The configuration as claimed in claim 9, wherein the second float is movable relative to the associated first or second baffle in a radially directed slot defined by the associated first of second baffle.

12. The configuration as claimed in claim 9, wherein the first or second one of the first or second baffles not associated with the second float defines an arcuate opening to permit movement of the associated second float with the other of the first or second baffle with which it is associated.

13. The configuration as claimed in claim 9, wherein the second float includes a second plurality of bodies.

14. The configuration as claimed in claim 13, wherein a second at least two bodies of the second plurality of bodies are on opposed sides of the associated first or second baffle.

15. The configuration as claimed in claim 14, wherein the second at least two bodies are connected to each other by the shaft that also secures the second at least two bodies to the associated first or second baffle.

16. The configuration as claimed in claim 1, wherein the first baffle and second baffle are spatially free to rotate to find level when the configuration is disposed other than horizontally, when in use.

17. The configuration as claimed in claim 1, further including a ball structure radially inwardly disposed of the first baffle and the second baffle.

18. A method for automatically allowing flow of a target fluid and choking flow of a nontarget fluid, comprising:

exposing a density-based flow control configuration, as claimed in claim 1, to a fluid;

automatically imparting torque in a first direction or a second direction to a first baffle depending upon a density of the fluid; and aligning or misaligning an opening in the first baffle with another opening to allow or choke, respectively, flow of the fluid.

19. The method as claimed in claim 18, wherein the imparting torque is by floating or sinking a float, that is secured to the baffle, in the fluid.

20. The method as claimed in claim 18, further including automatically imparting torque in a first direction or a second direction to a second baffle adjacent the first baffle, depending upon a density of the fluid.

21. The method as claimed in claim 18, wherein the another opening is in a second baffle, the second baffle being positionable relative to the first baffle.

22. A wellbore system, comprising:

a borehole in a subsurface formation;

a string in the borehole; and a density-based flow control configuration, as claimed in claim 1, disposed within or as a part of the string.

23. A density-based flow control configuration, comprising:

a housing;

a first baffle mounted in the housing and having a first flow opening;

a second baffle having a second flow opening adjacent the first baffle, at least a first one of the first baffle and the second baffle being rotationally movable relative to the housing and to the other of the first baffle and the second baffle;

first selected density float mechanically connected by a shaft with the rotationally movable one of the first or second baffles, the first float imparting torque to the associated baffle dependent upon a density of a fluid to which the first float is exposed, during use, the torque causing alignment or misalignment of the first and second openings depending upon the density of the fluid to which the first float is exposed, during use, wherein the outer housing includes a ball cavity, and wherein the first baffle and second baffle are spatially free to rotate to find level when the configuration is disposed other than horizontally, when in use.

* * * * *